US005371993A

United States Patent [19]

Saito

[11] Patent Number: 5,371,993

[45] Date of Patent: Dec. 13, 1994

[54] FRAME CONSTRUCTION METHOD

[75] Inventor: Makoto Saito, Tokyo, Japan

[73] Assignee: Kajima Corporation, Tokyo, Japan

[21] Appl. No.: 209,296

[22] Filed: Mar. 10, 1994

Related U.S. Application Data

[62] Division of Ser. No. 772,707, Oct. 7, 1991, Pat. No. 5,327,960.

[30] Foreign Application Priority Data

| | | | |
|---|---|---|---|
| Jun. 20, 1990 | [JP] | Japan | 3-148372 |
| Oct. 8, 1990 | [JP] | Japan | 2-270059 |
| Nov. 30, 1990 | [JP] | Japan | 2-334233 |
| Feb. 1, 1991 | [JP] | Japan | 2-011960 |

[51] Int. Cl.[5] ..... E04B 1/00

[52] U.S. Cl. ..... 52/245.1; 52/749; 52/118; 52/123.1; 182/141

[58] Field of Search ..... 52/118, 125.1, 749, 52/745.02, 745.17, 745.18, 123.1, 745.09, 745.1, 173.1, 750; 182/141, 149; 414/11

[56] References Cited

U.S. PATENT DOCUMENTS

| | | | |
|---|---|---|---|
| 3,217,896 | 11/1965 | Cannella . | |
| 3,802,136 | 4/1974 | Eiler et al. | 52/118 |
| 3,851,854 | 12/1974 | Roybal | 182/141 X |
| 3,858,688 | 1/1975 | Galloway | 182/141 X |
| 3,877,582 | 4/1975 | Moore | 414/11 |
| 3,974,618 | 8/1976 | Cortina | 52/125.1 |
| 4,027,802 | 6/1977 | Reynolds | 52/118 |
| 4,482,130 | 11/1984 | Paredes | 414/11 |
| 4,657,112 | 4/1987 | Ream et al. | 52/118 |
| 4,752,102 | 6/1988 | Rasmussen | 182/141 X |
| 4,884,938 | 12/1989 | Fujita et al. | 414/11 |
| 5,018,923 | 5/1991 | Melan et al. | 52/749 |

FOREIGN PATENT DOCUMENTS

| | | |
|---|---|---|
| 64548 | 11/1955 | France . |
| 1181529 | 6/1959 | France . |
| 1305537 | 8/1962 | France . |
| 2312509 | 10/1974 | Germany . |
| 837036 | 6/1960 | United Kingdom . |
| 9009497 | 8/1990 | WIPO . |

*Primary Examiner*—Carl D. Friedman
*Assistant Examiner*—Lan C. Mai
*Attorney, Agent, or Firm*—Knobbe, Martens, Olson & Bear

[57] ABSTRACT

The present invention provides a frame constructing method for constructing frames for reducing the cost for assembling frames, for making it possible to execute the construction works under any weather conditions, further for shortening the term of works, and for enabling to improve safety in the executions, to automate the executions and to save labor. The erection workbench for constructing frames have an extension column (2) provided at the inside of four column members (C) composing the minimum unit of the frames, a workbench (1) erected between the intermediate portions of the extension column (2), a roof (4) or a workbench (8) erected between the top portions of the extension column (2), and a lifting crane (3) suspended from the workbench (1) or the roof (4) or the extension column (2), and the extension column (2) is composed of a fixed column (2*a*) supported to a beam member (B) at the downstairs side and a column base (2*b*) connected to the lower end of the fixed column (2*a*) and expandable and retractable with respect to the fixed column (2*a*).

9 Claims, 11 Drawing Sheets

FRAME CONSTRUCTION METHOD

This is a divisional application of U.S. pat. application Ser. No. 772,707, filed Oct. 7, 1991 by an inventor Makoto Saito and entitled "ERECTION WORK BENCH FOR CONSTRUCTING A FRAME AND A FRAME CONSTRUCTION METHOD", now U.S. Pat. No. 5,327,960.

FIELD OF THE INVENTION

This invention relates to an erection workbench for constructing a frame of a building and a frame construction method by utilizing the erection workbench, and more particularly, to an erection workbench for constructing a frame of a building and a frame construction method for assembling preliminarily prepared beam members and column members made of a steel frame structure or a precast concrete structure or the like at a construction site.

BACKGROUND OF THE INVENTION

In constructing a frame of a building by assembling column members and beam members which are made of structural steel or precast concrete at a work site, a method shown in FIG. 17 is generally employed. In this conventional method, the process for constructing the frame of the building is progressed by lifting up the column members and the beam members with the use of a lifting crane placed on the circumferences of the building to be erected or on the constructed beams or slabs for the building. Such column members and beam members are assembled and combined under the condition having no work scaffolds.

In this conventional method, for example, an arm derrick type tower crane, an arm horizontal type tower crane or the like, as shown in FIG. 17, are used for lifting the beam and column members. The cranes to be used in a construction site are difficult to change positions once they are fixed on the frame of the building or on the ground, and thus, it is preferable in the conventional process to utilize relatively large cranes which can lift the column and beam members to the position higher than the top of the building to be built so that these cranes can be used until the final stage of the construction of the building without changing the positions. Further, for the sake of workability and efficiency the numbers of cranes to be used in the construction area are limited to a certain small numbers. In such cases, again, cranes with larger lifting radii are commonly used so as to reach to the end of the building. As a result, as shown in FIG. 17, the crane 19 is scaled up and becomes heavier, which requires that the columns C and beams B of the building to be built have to be reinforced by placing braces 18 within the frames in order to support the load of the cranes. If such cranes are attached on the ground of the construction site, the special foundation for the cranes on the ground becomes necessary to fully support the weight of the cranes. Therefore, the conventional method for assembling a frame inherently results in considerable cost increase.

In addition, in the conventional methods, scaffolds cannot be provided to the columns and the beams until the assembly of frames is completed. The scaffold is a temporary platform used by workers in the construction of a building. Thus, the assembling work in the conventional method has to be practiced in the condition having no scaffolds. Therefore, the construction workers have to practice under the very dangerous condition where they directly climb the columns and walk on the beams, resulting in the serious shortage of workers.

Furthermore, since a roof or a cover cannot be placed during the constructing process of frames in the conventional method, the assembly work has to be done on the wet steel structure, for example, in case of rain, which further increases danger in the working condition. Due to such serious increase of danger, the works under the rainy weather has to be stopped or postponed.

SUMMARY OF THE INVENTION

In consideration of these conventional disadvantages in assembling frames for a building, it is an object of the present invention to provide a new apparatus and method not only for reducing frame assembling cost also for enabling to execute the assembling work under any weather conditions.

It is another object of the present invention to decrease time length for such assembling works while at the same time improving the safety for workers.

The further object of the present invention is to provide a frame construction process for constructing frames and an erection workbench for assembling frames which is capable of automatic execution of the assembly works and, as a result, to overcome a labor shortage problem.

In accordance with the present invention, an erection workbench for constructing frames (hereinafter referred to as "erection workbench") and a method for constructing frames are comprised as described below.

The erection workbench of the present invention is comprised of a plurality of extension columns positioned in an inside area defined by, for example, four column members which form the minimum unit of the frame to be constructed, a workbench which is provided at the intermediate position of the extension columns, a roof installed at the top of the extension column, and a lifting crane attached vertically to the workbench or to the roof. The extension column is composed of a fixed column supported by the beam members of the frame at the downstairs side and a column base connected expandably to the lower end of the fixed column. The extension column includes a drive mechanism such as a hydraulic cylinder or a winch so that the column base can elongate from the fixed column and thus lift up the workbench upstairs.

In another aspect of the present invention, wheels are provided on tie-beams which are attached to the lower end portion of the column base or to the lower end of the fixed column of the extension column so that the erection workbench can slidably move in a horizontal direction back and forth on the beam members. Thus, in this embodiment, the erection workbench not only climbs up the frame of the building but also freely changes positions in the horizontal direction of the frame.

Another aspect of the present invention is an erection workbench which has a plurality of workbenches, the top of which also serves as a roof. On the workbench (roof) which positioned at the top, various kinds of construction machines including a crane can be installed for further increasing the working efficiency and flexibility.

A method for constructing frames according to the present invention is accomplished by the following process.

First, the column members and the beam members of the frame to be assembled are lifted up to upstairs by the lifting crane installed vertically to the workbench or to the roof. Then, the column members and the beam members are assembled into a frame of the upstairs. After assembling the frame of the upstairs, the fixed columns of the extension columns are released. The base columns of the extension columns elongate with respect to the beam members of the downstairs and, as a result, push up the workbench to the next level of the frame to be assembled. The fixed columns of the extension columns are attached to the beam members of the upstairs which have just assembled prior to the climbing up of the workbench. The elongated base columns are retracted into the extension columns. Thus, the erection workbench has completed in climbing up one layer of the frame.

Again, the beam members and the column members are brought up by the lifting crane for assembling the frame for the nest upstairs. Therefore, the frames are constructed in turn toward an upper direction by repeating such procedures of lifting up assembling materials while at the same time the erection workbench moves in both vertical and horizontal directions until the assembly work for the frame of the building is finished. The frames are also constructed in turn in a lateral direction while moving the erection workbench laterally by sliding it on the already constructed beams.

In the present invention, the filling and loading of the frame materials, i.e., beam members and column members on the erection workbench is practiced by the workbench itself while making the extension columns support the workbench. The workbench of the present invention not only works as a scaffold for workers but provides expandable and retractable scaffolds at the end of the workbench. The erection workbench of the present invention obviates the large scale cranes required in the conventional method, since the erection workbench can climb up the frame one layer by one layer while bringing the frame materials from the ground and assembling such materials into the frame. The erection workbench in accordance with the present invention can also move horizontally on the beam members by providing wheels on the workbench which slide on the beam members that have been assembled. In this configuration, erection workbench of the present invention moves around horizontally from one frame unit to other and, as a result, it can obviate a tower crane having a long lifting arm since the erection workbench can reach any position of the building under construction. Since no large-scale tower crane is needed for lifting up the column members and the beam members, in accordance with the present invention, the reinforcement of the column members and the beam members for fixing the large cranes becomes unnecessary which greatly improves reduction of cost and time for construction of a building.

The safety in execution of the assembly work can greatly be improved by practicing the assembly work of the columns and the beams on the workbench and on the scaffolds which are provided at the ends of the workbench. A series of execution such as welding and bolting works at the time of column and beam assembly can be made automatically by loading various constructing robots such as an assembling robot and a welding robot on the workbench. Furthermore, any weather influences can be overcome and the efficiency in executions can be improved by erecting a roof at the top of workbench.

BRIEF DESCRIPTION OF THE DRAWINGS

FIGS. 11 through 13 show the wheel-fixing portion of the erection workbench of the present invention, wherein FIGS. 11 and 13 are plan views and FIG. 12 is a longitudinal sectional view.

FIGS. 14, 15 and 16 show further embodiment of the erection workbench in accordance with the present invention, wherein FIG. 14 is a schematic plan view, FIG. 15 is a sectional view taken along the line a–a of FIG. 14, and FIG. 16 is a sectional view taken along the line b—b of FIG. 14, respectively.

DETAILED DESCRIPTION OF THE INVENTION

Figure 1:
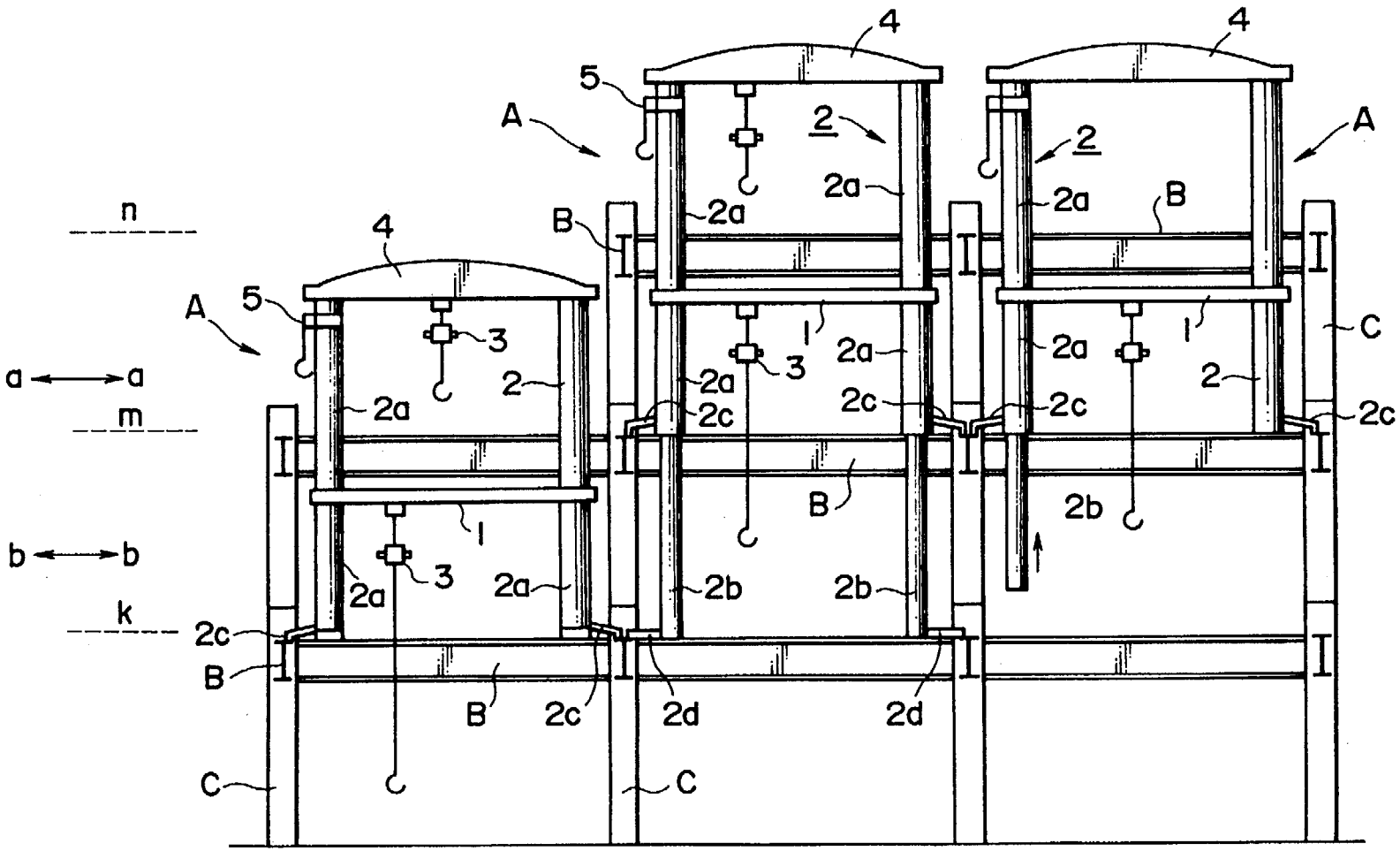
FIG. 1 is a side view showing the major structure and procedure for constructing a frame of a building by an erection workbench in accordance with the present invention.

The present invention is an erection workbench for constructing a frame of a building composed of column members and beam members of steel structure or precast concrete structure and a method for constructing the frame by using the erection workbench. In the present invention, as in FIG. 1, the frame is constructed by assembling the beam members B and the column members C by utilizing the erection workbench A of the present invention.

The erection workbench A is comprised of a plurality of extension columns 2 positioned close to the column member C, a workbench 1 attached at the intermediate position of the extension columns 2, a roof 4 provided at the top of the extension column 2, and a lifting crane 3 attached vertically to the workbench 1 or to the roof 4.

Figure 2:
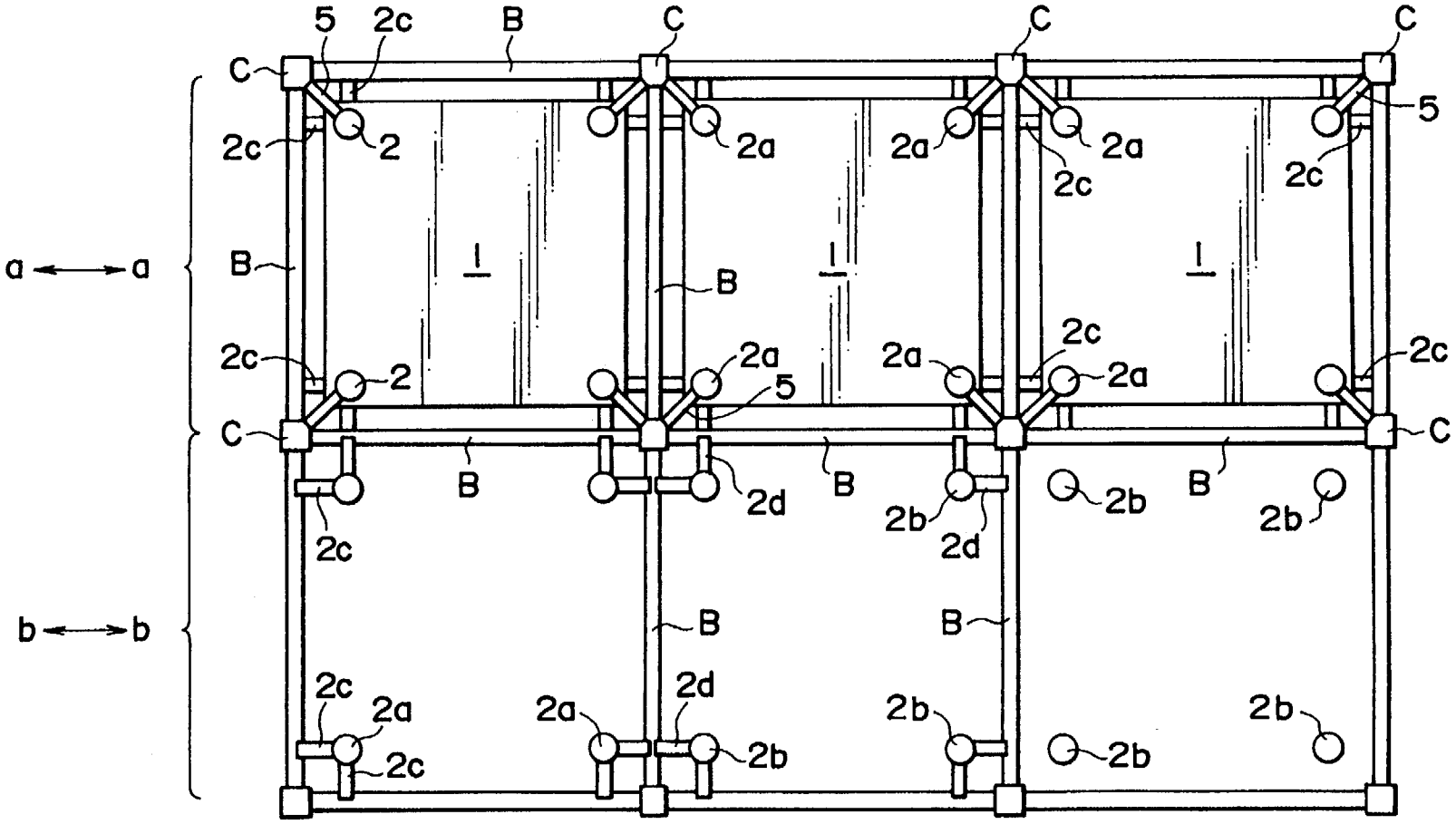
FIG. 2 is a plan view showing the frame and the erection workbench of FIG. 1.

Each of the extension columns 2 of the erection workbench A is disposed in an area of the building defined by the corresponding column members C. Four of the column members C form the minimum unit of the frame to be constructed for the building as shown in FIG. 2. The workbench 1 has the flat area defined by the four corner of this minimum unit.

Figure 3:
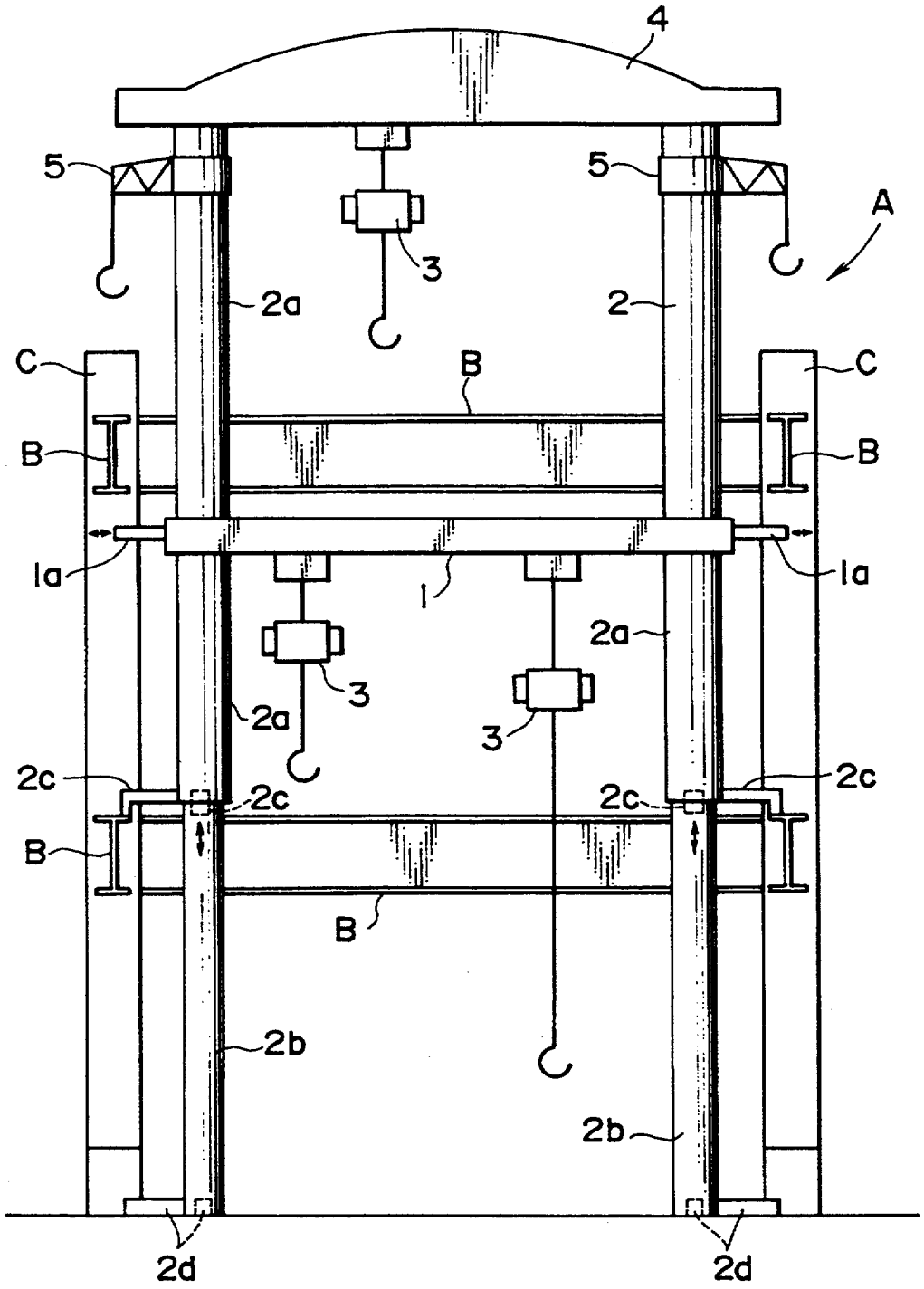
FIG. 3 is a side view showing the erection workbench and the frame of the present invention.

The lifting crane 3 is suspended from the workbench 1 as shown in FIGS. 1 and 3. The lifting crane 3 is attached to the workbench 1 in a manner which is freely movable in a horizontal direction by using, for example, a monorail or other means for increasing efficiency and flexibility of the construction work.

The extension column is composed of a fixed column 2*a* supported by the beam members B of the frame at the downstairs side and a column base 2*b* connected expandably and retractably to the lower end of the fixed column 2*a* as shown in FIGS. 1 to 3. The extension column 2 includes a drive mechanism such as a hydraulic cylinder or a winch so that the column base can elongate from the fixed column and thus the extension column push up the workbench to the upstairs.

Support arm 2*c* for connecting the erection workbench A to the beam member B are projected on the lower end of the fixed column 2*a* so that the support arm 2*c* can be attached on the nearest beam member B as illustrated in FIG. 3. As shown in FIG. 2, a plurality of the support arms 2*c* are preferably used in an orthogonal manner with each other to strengthen the connection with the beam members B. Further, in the preferred embodiment of FIGS. 1 to 3, the support arms 2*c* are so arranged that they can extend from the fixed column 2*a* and also retracted into the fixed column 2*a*. The reason of this retractable and extendable structure is to avoid the collision against the upstairs beams B when the workbench 1 is raised to the upstairs. Therefore, the support arm 2*c* can also be attached to the fixed column 2*a* in a hinge structure.

FIG. 2 shows a plan view taken along lines a—a and b—b in FIG. 1. The fixed column 2*a* has a sufficient length passing through the workbench 1 from the beam B on the underside of the workbench 1 and leading to the roof 4 (FIGS. 1 and 3).

The column base 2*b* is pulled back for storing it within the fixed column 2*a* as shown in the right side of FIG. 1. The column base 2*b* has a support arm 2*d* at its lower end for connecting the column base 2*b* to the beam member B. The support arm 2*d* is used for receiving the load given at the time when the extension column 2 expands for the erection workbench A to climb up the frame. Thus, the weight of the workbench A is provided to the beam members B through the base column 2*b* and the support arm 2*d*. Similar to the support arms 2*c* of the fixed column 2*a*, a plurality of the support arms 2*d* are preferably used in the orthogonal manner with each other to strengthen the connection with the beam members B. Further, in the preferred embodiment of FIGS. 1 to 3, the support arms 2*d* are formed so that they can extend and retract with respect to the base column 2*b*.

Figure 4:
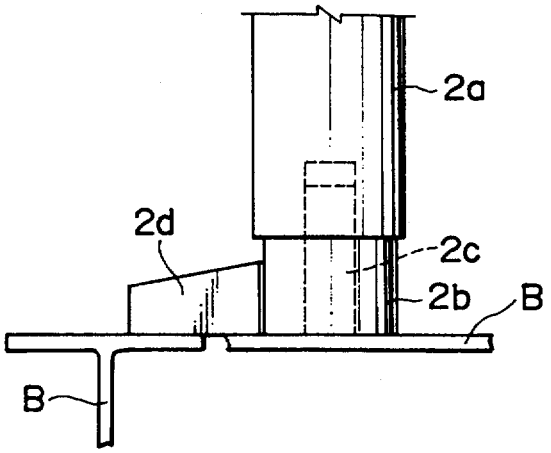
FIGS. 4 and 5 are side views showing the details of the support arms of the extension column at the storing status of the column base, and also are fragmentary views taken in X and Y directions of FIG. 7, respectively.
Figure 5:
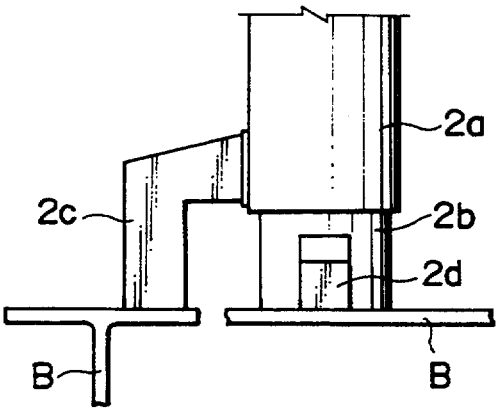

FIGS. 4 through 7 show examples of mechanisms for connecting the extension columns 2 to the beam members B at the storing time of the column base 2*b*. FIGS. 4 and 5 are fragmentary views taken at lines X and Y of FIG. 7, respectively.

At the storing time of the column base 2*b*, the load of the erection workbench A is supported by both the support arm 2*c* for the fixed column 2*a* and the support arm 2*d* for the column base 2*b* stored in such a condition, for example, that the end portion lower than the support arm 2*c* is exposed as shown in FIGS. 4 and 5.

Figure 6:
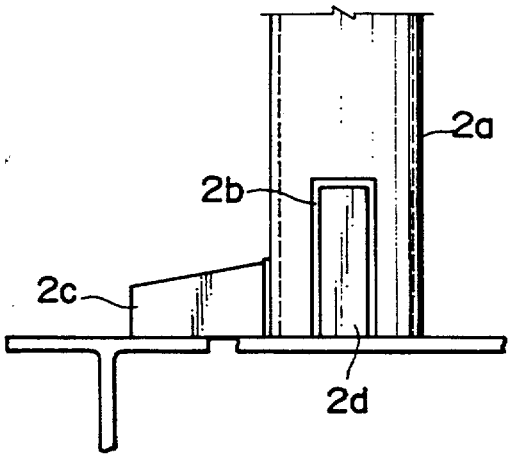
FIG. 6 is a fragmentary view showing the modification of the extension column of FIGS. 4 and 5 and taken in the Y direction of FIG. 7.
Figure 7:
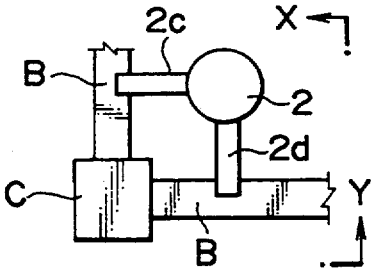
FIG. 7 is a partial plan view of FIG. 2 showing the extension column of the workbench, the column member and the beam member.

FIG. 6 shows the modification of FIGS. 4 and 5. In FIG. 6 the column base 2*b* is completely stored within the fixed column 2*a*, the support arm 2*d* for the column base 2*b* is projected from the cut-out formed at the lower end of the fixed column 2*a*, and the load of the erection workbench A is supported by the projected support arm 2*d* of the column base 2*b* and the support arm 2*c* for the fixed column 2*a*.

At the time of assembling the column members C and the beam member B into the frame, the column base 2*b* is stored in the fixed column 2*a*. After the assembly of a single layer of the frame is completed, the column base 2*b* expands to raise the fixed column 2*a* and the workbench 1 to the upper layer. Then the column base 2*b* is pulled back into the fixed column 2*a* to be stored after the erection workbench A is fixed to the beam members B in the upper layer. Although not shown, this extension operation is undertaken by a drive mechanism such as a hydraulic cylinder or a winch provided in the extension column 2.

The roof 4 is supported by the fixed column 2*a* which continues from the four corners of the workbench 1 to the fixed column 2*a* of the extension column 2. The roof 4 has a flat area larger than that of the workbench 1, and its circumference overhangs from the workbench 1 as illustrated in FIG. 3. The working condition on the workbench 1 will be improved and thus the efficiency of construction works can be improved by using the material penetrated by light for the roof 4.

The lifting crane 3 is provided to the workbench 1, and if necessary, it is also possible to be suspended from the roof 4. In the embodiment of FIG. 3, another type of the lifting cranes 5 are attached to the external side of the extension column 2 for lifting mainly the column members C or the beam members B. These lifting cranes 3 and 5 are used not only for the setting of the column members C and the beam members B into the frame but also for making exterior structures such as a curtain wall.

Further, in the embodiment of FIG. 3, movable scaffolds 1*a* overhanging horizontally from the workbench 1 are provided to improve the efficiency of the construction works. Thus, in the erection workbench of the present invention, the construction workers can practice their jobs freely on the workbench 1 and on the movable scaffolds 1*a*, which greatly improves the working efficiency and safety. The scaffolds 1*a* are withdrawn from the outside of the workbench 1 and stored inside of workbench 1 when the workbench A moves up to the upstairs.

Since the dimension of the erection workbench 1 becomes variable due to the built-in type of this movable scaffold 1*a* as described above, the erection workbench A of the present invention can also be applied to the frames witch the different size of the minimum unit, i.e., the minimum frame unit of considerably larger than the size of the workbench 1 of the erection workbench A. Thus, in accordance with this embodiment, it is not necessary to prepare a large number of erection workbenches of different sizes for the variation of the size of the frame unit, which also contributes reduction of the cost. Furthermore, in case where the flat area of a single unit of the frame to be assembled is relatively smaller than that of the workbench 1, the erection workbench A is provided at the further inside of the four columns C corresponding to the size of the flat area.

The erection workbench A can be provided on every frame unit of a single layer as shown in FIGS. 1 and 2, and is independently lifted to the upper layer, respectively. As will be described later, the erection workbench A of the other embodiment can move around not only in a vertical direction but also in a horizontal direction. Thus, in that case, only one or two erection workbenches of the present invention will be satisfactory for the construction of even a large scale building.

Referring now to FIGS. 1 and 2, the procedure for executing layers of the frame structure is described. First, after lifting the workbench 1 up to the position of the beam member B on the upstairs of the layer (k) where the frame assembly work of the layer is completed, the erection workbench A is supported by the beam member B by fixing the fixed column 2*a* to the beam member B on the downstairs side (m) by the support arms 2*c* as shown on the left side in FIG. 1. The base columns 2*b* are stored within the fixed columns 2*a*.

In this condition, the column members C and the beam members B are erected and connected by lifting up these members from the ground for instance, with the use of the lifting cranes 3 and the outside lifting crane 5 which are suspended from the workbench 1 and the roof 4 and the fixed column 2*a*. During this time period, other works such as assembling the downstairs floor slabs are executed by the lifting crane 3 attached to the underside of the workbench 1.

Then, the support arms 2*d* at the lower end of the base column 2*b* are attached to the beam members B on the down layer (k) for supporting the weight of the erection workbench A through the base columns 2*b* instead of fixed columns 2*a*. At the same time, the support arms 2*c* at the bottom of the fixed columns 2*a* are disconnected from the beam members B. By the force provided in the extension column 2 such as a hydraulic cylinder (not shown) the erection workbench A including the workbench 1 and the fixed column 2*a* are lifted to the upper layer in making the column base 2*b* extended. The support arms 2*c* are taken out from the fixed column 2*a* and connected to the beam members B of the layer (m) as shown in the center of FIG. 1. Then, the support arms 2*d* on the column base 2*b* are retracted to be stored inside of the fixed column 2*a*, by the process as shown at the right side of FIG. 1. At this level, the frame in the layer (n) is assembled by hoisting the column members C and the beam members B with the use of the lifting cranes 3 and 5 as describe above. By repeating this procedure, the frame of the building is assembled step by step until the top of the building.

Figure 8:
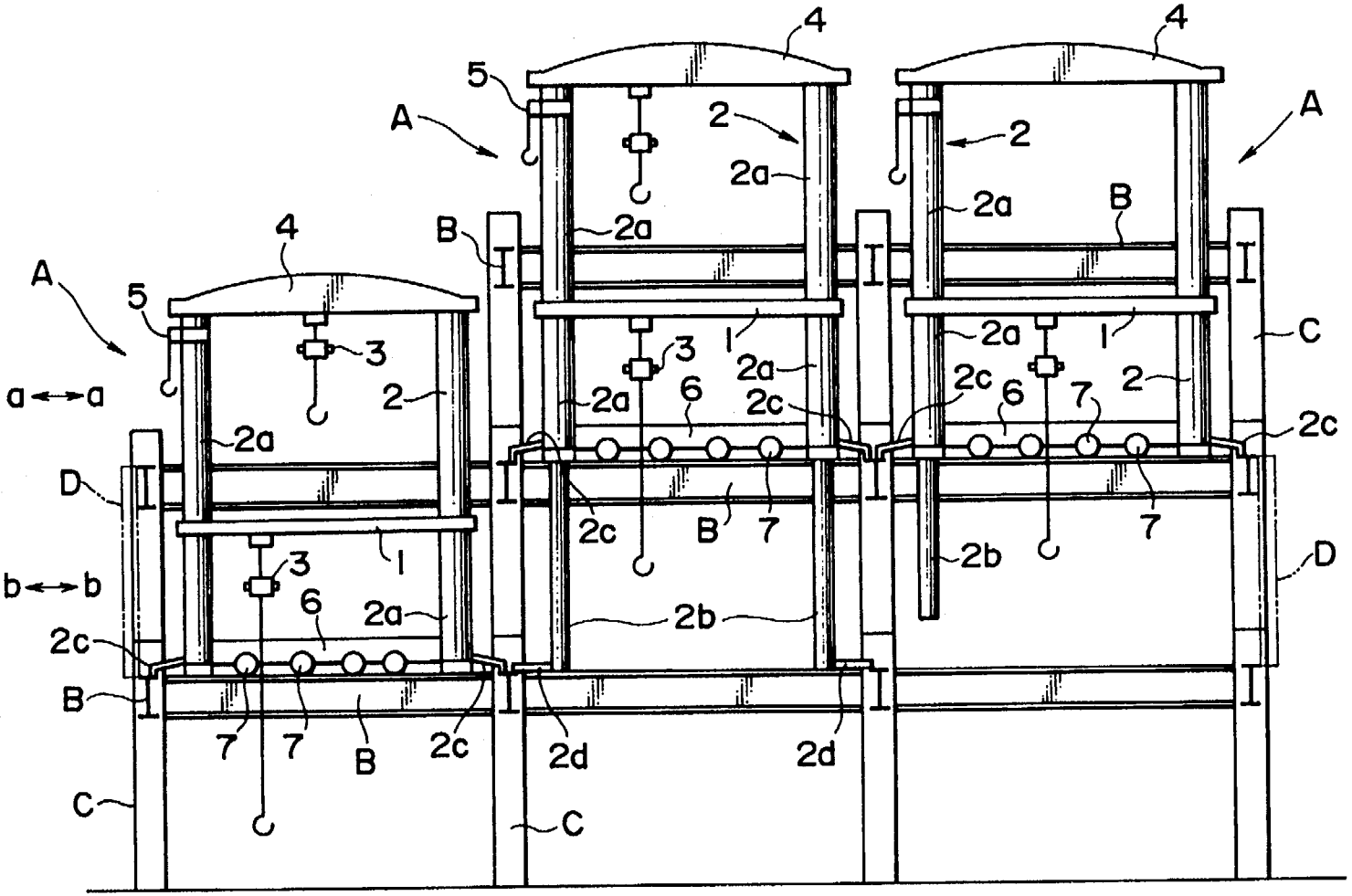
FIG. 8 is a side view showing the essential feature of erection workbench and the process of constructing the frame in accordance with the another embodiment of the present invention.
Figure 9:
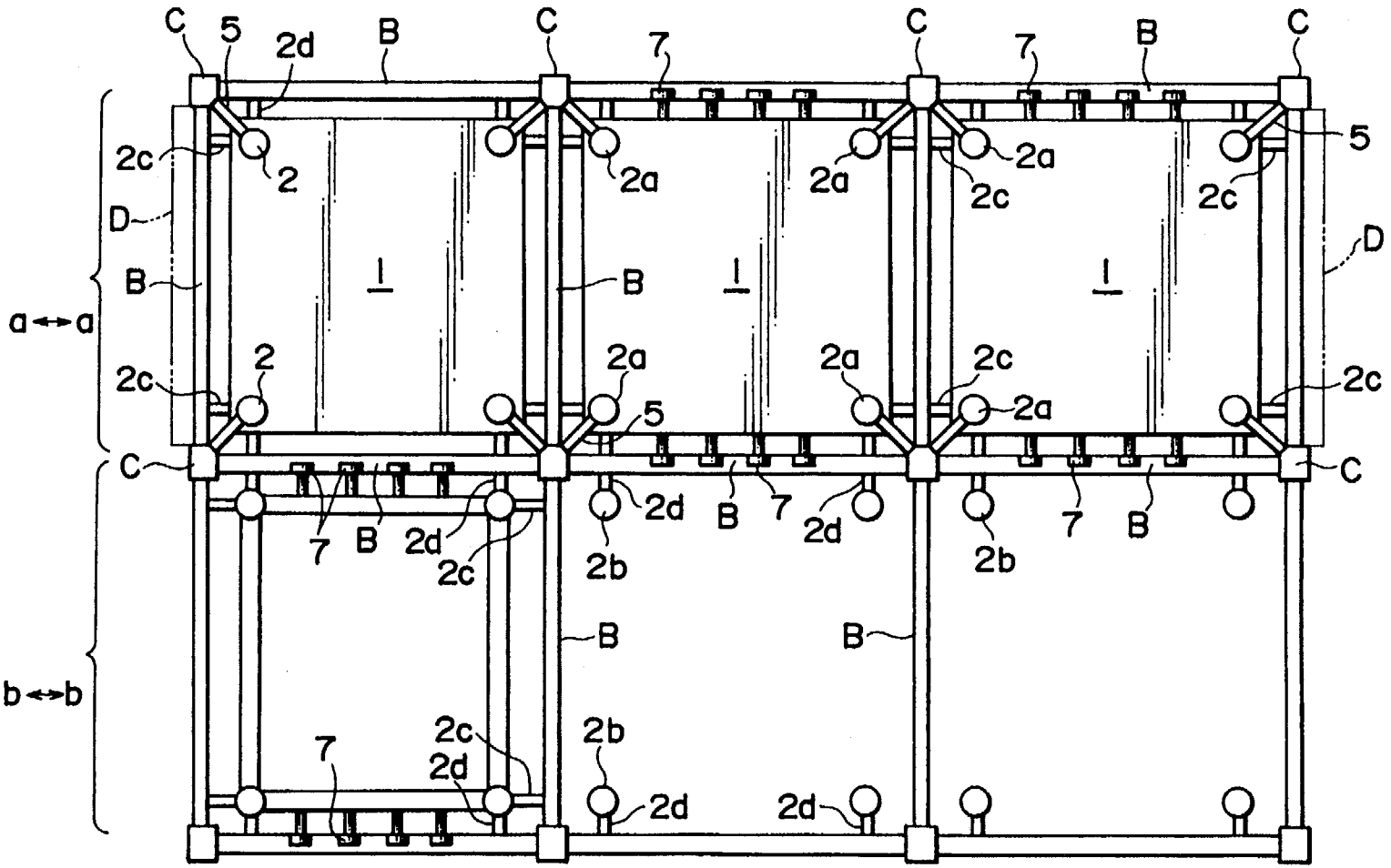
FIG. 9 is a plan view showing frame and the erection workbench of the embodiment of FIG. 8.
Figure 10:
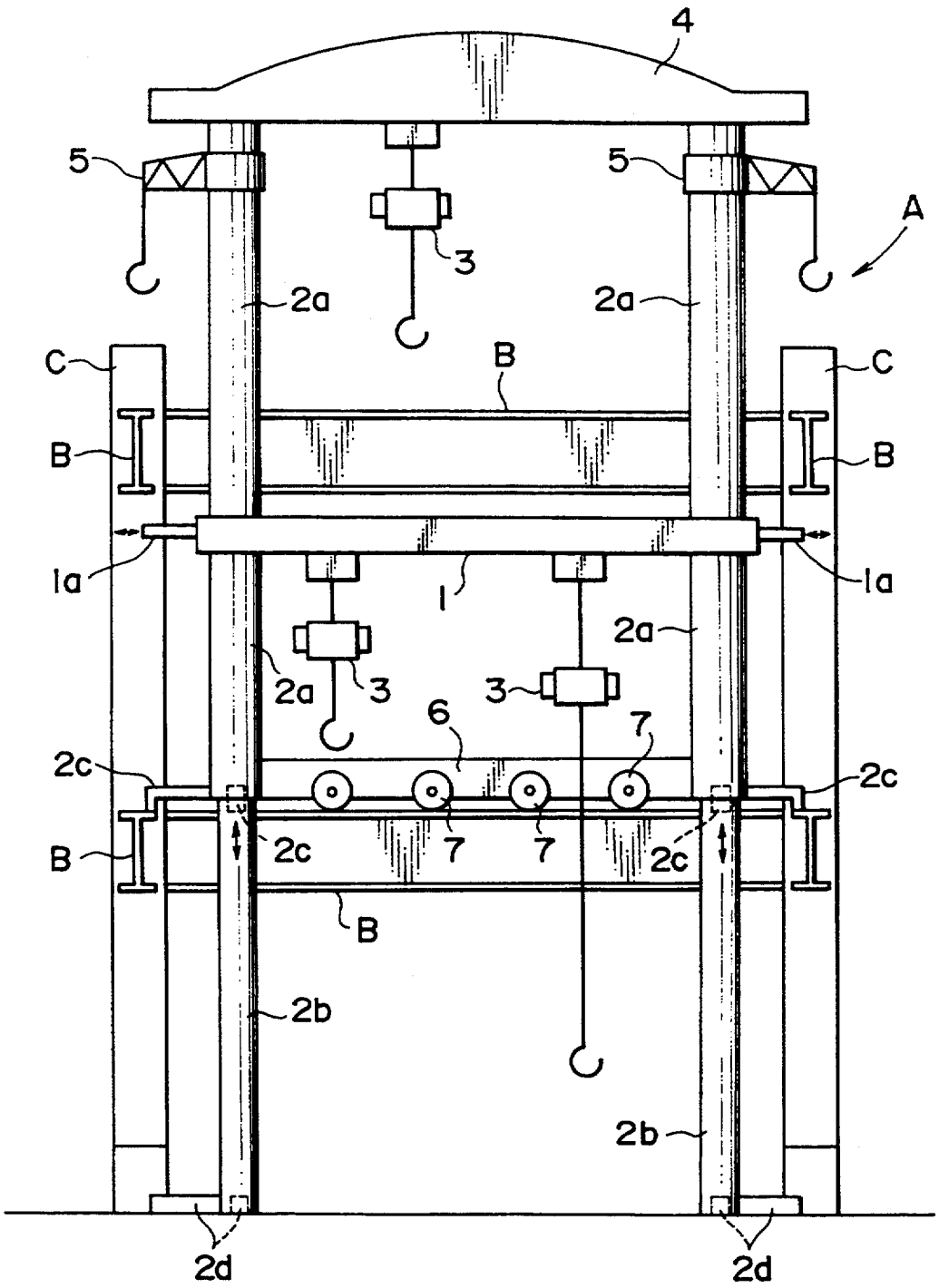
FIG. 10 is a side view showing the erection workbench of FIG. 8 having the wheels.
Figure 11:
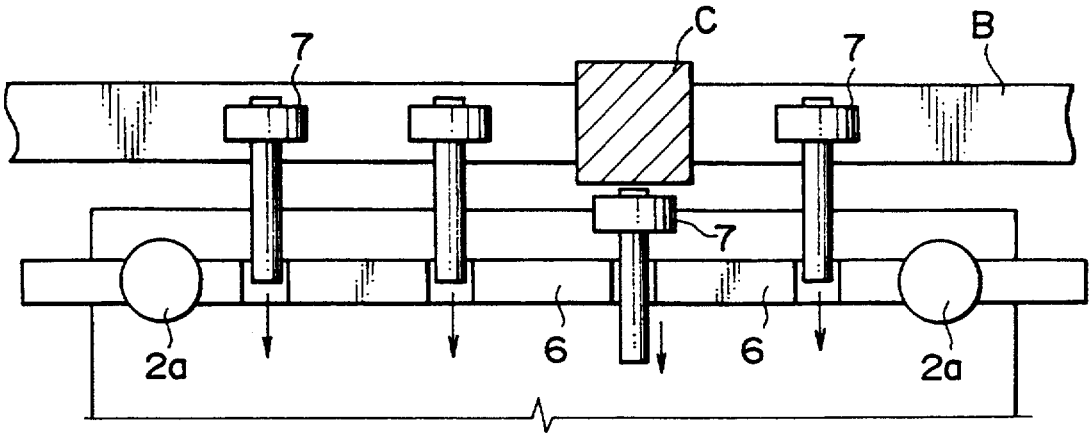
Figure 12:
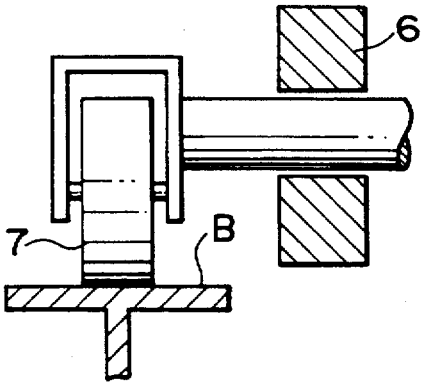

FIGS. 8 through 13 show other embodiments of the erection workbench for constructing frames in accordance width the present invention. In the this embodiment, a plurality of tie-beams 6 which are parallel with each other and are horizontally attached to the lower end of the fixed columns 2*a* of the extension columns 2. A plurality of wheels 7 for slidably moving the workbench 1 on the erected beam members B by a drive mechanism (not shown) are installed on the tie-beams 6 at a certain interval in a longitudinal direction as shown in FIG. 8. In this configuration, the erection workbench A can move in a horizontal direction from one frame unit to the other.

In such a case, as the width of the column member C is normally larger than that of the beam member B, it is necessary for the wheels 7 to bypass the column members C when the erection workbench A changes position to the next frame unit. Therefore, the wheels 7 are arranged so that they can reciprocally and axially move on the beam members B (best shown in FIGS. 11 and 12) or rotatably move by means of hinges (best shown in FIG. 13). The wheels 7 can also be arranged attachably or detachably (not shown) from the tie-beams 6.

As a result, the erection workbench A can freely move in a horizontal direction either front and rear or left and right on the already erected beams B in addition to move vertically. Furthermore, in case where the tie-beams 6 are erected at the four corners of the fixed column 2*a* and the wheels 7 are respectively provided, the erection workbench A can freely move in a horizontal plane of either front, rear, left or right direction.

In a configuration shown in FIGS. 8 to 13, the process for constructing frames is described as below. First, after the workbench 1 is moved upwards to the position of the beam member B on the side of the already erected upstairs, the erection workbench A is supported to the beam members B by fixing the fixed columns 2*a* to the beam members B on the downstairs through the support arms 2*c* by the process shown in the left side of FIG. 8, and at the same time, the wheels 7 are locked so as not to rotate at this stage. The column bases 2*b* are also stored in the fixed columns 2*a*.

In this condition, the column members C and the beam members B are lifted up by the lifting cranes 3 and 5 suspended from the workbench 1 and the roof 4, respectively, to practice their erection and connection for making the frame. During this time period, other works such as an execution of the floor slabs on downstairs is also performed with the use of the lifting crane 3 at the underside of the workbench 1.

After all the processes within the reachable range of the workbench 1 is completed, then the fastening for the support arms 2*c* and the lock for the wheels 7 are temporarily released so as to make the erection workbench A movable. Furthermore, as the total weight of the erection workbench A loads on the wheels 7 in such a condition, at least four wheels 7 are provided on one side of the erection workbench A to firmly support the erection workbench A.

Then, the erection workbench A is slid on the beam members B and moved laterally to the next frame unit. Next, the erection workbench A is connected to the beam members B by fixing the fixed column 2*a* to the beam members B again by the support arms 2*c*. In addition, for practicing the works with safety, it is desirable that the works are practiced in the condition that the erection workbench A is completely fixed to the beam members B by the support arms 2*c*. In case of a simple work, however, the work can be performed by supporting the erection workbench A only by the wheels 7 without fixing the extension columns 2 to the beam members B by the support arms 2*c*.

When the construction of the same floor, that is, the floor on which the erection workbench A is installed is completed, the wheels 7 are locked for preventing their rotation and thus the horizontal movement. By the process shown at the center in FIG. 8, both the workbench 1 and the fixed column 2*a* are moved upwards for one layer by extending the column bases 2*b*, and the erection workbench A is supported to the upstairs beams B by attaching the support arms 2*c* from the fixed columns 2*a* onto the upstairs beam members B. Subsequently, by the process shown in the right side of FIG. 1, the column base 2*b* is stored in the fixed column 2*a*. In addition, the wheels 7 are aligned on the upstairs beams B for the horizontal movement. By repeating the above procedures, the frames are assembled until the top of the building while moving the erection workbench A in the horizontal direction and the vertical direction.

Figure 14:
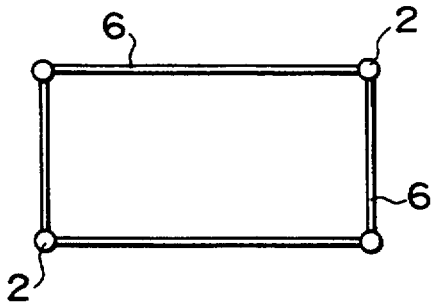
Figure 13:
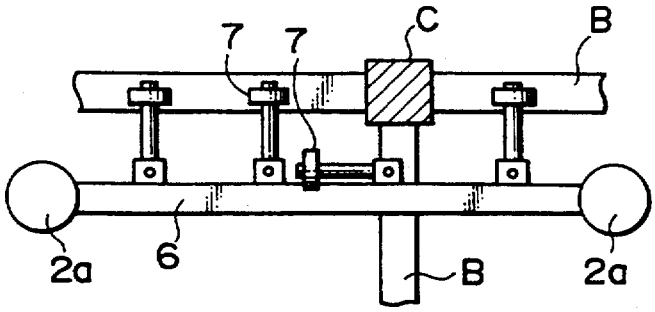
Figure 15:
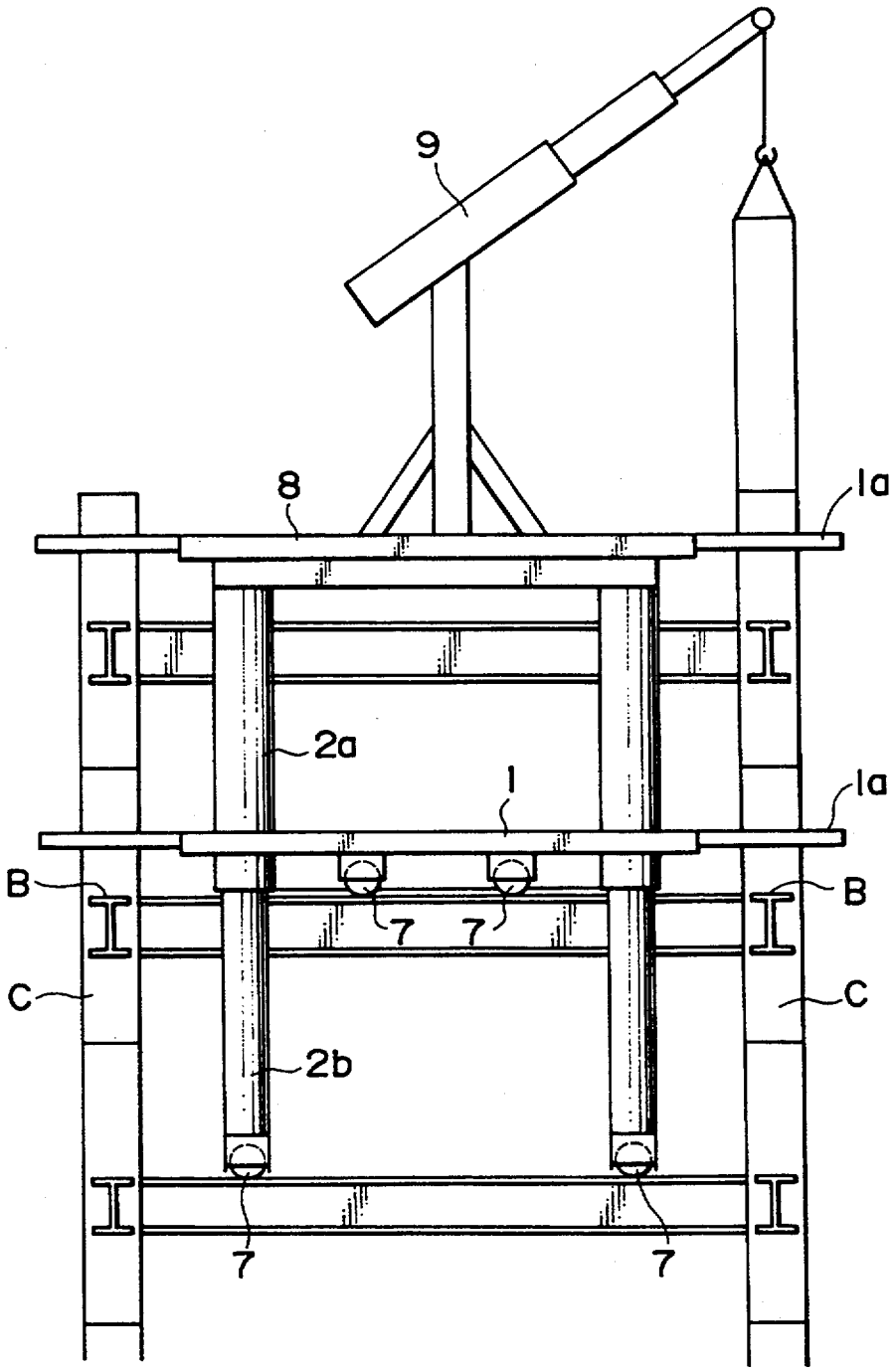
Figure 16:
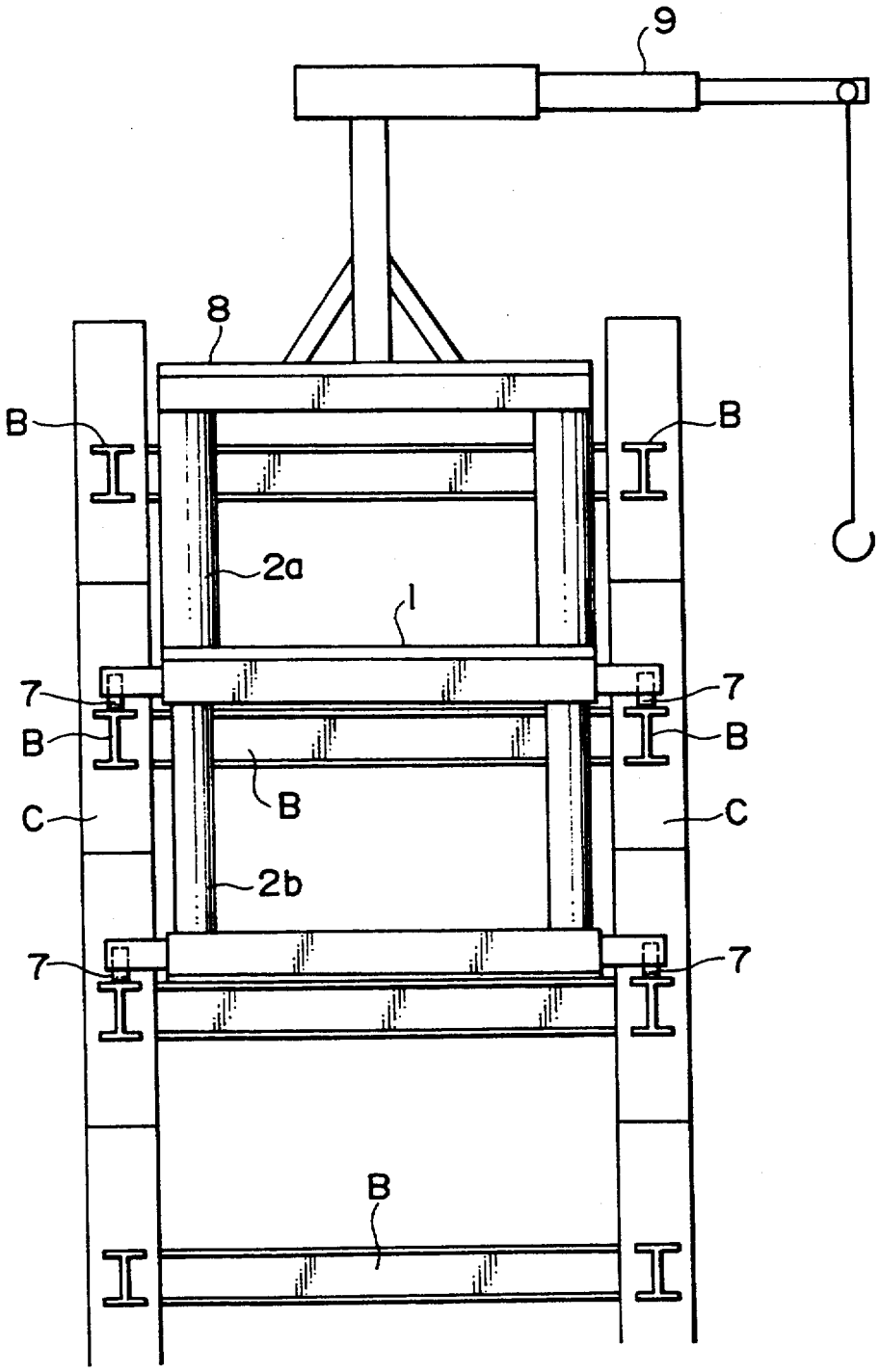
Figure 17:
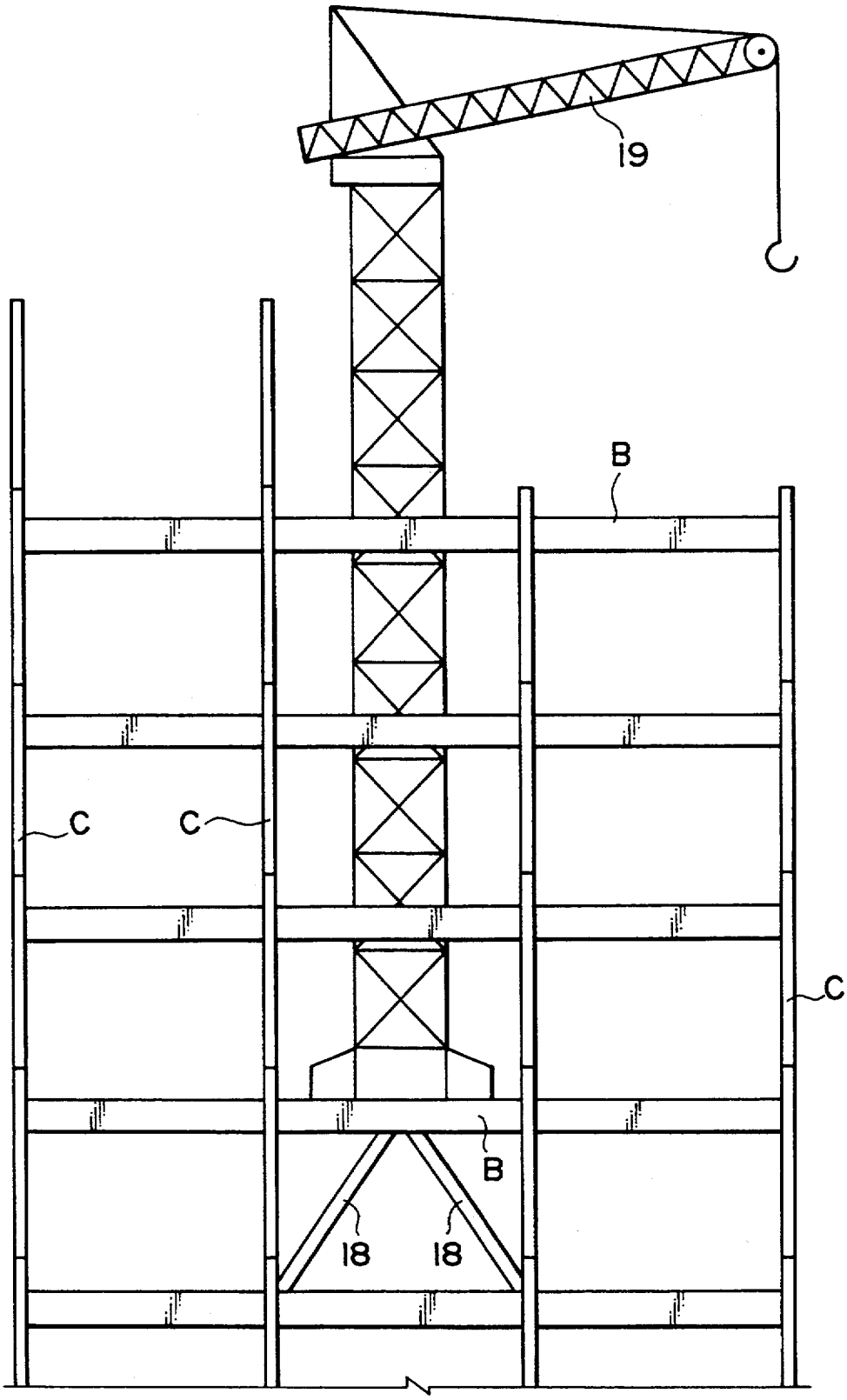
FIG. 17 is a side view showing a prior art structure and process for constructing frames of a building.

FIGS. 14, 15, and 16 show further embodiments of the erection workbench A according to the present invention. In this example, instead of installing the roof 4 between the top portions of the posts 2, a workbench 8 is provided to be used both as a roof and a workbench, on which various construction machines corresponding to the object to be used as a lifting crane 9 or the like are provided. Other configurations are substantially the same as the preceding embodiments.

With the use of this erection workbench A as illustrated in FIGS. 14 to 16, various kinds of works can be proceeded at the workbench 8 and at the upper and lower areas of the workbenches 1 and 8, and therefore, the efficiency in construction works is considerably improved. Furthermore, as the lifting cranes provided on the ceiling of the workbench 1 and the extension column 2 of FIGS. 1, 3, 8 and 10 become unnecessary, further improvement in the safety of the construction works can be attained as well.

As has been described above, according to the present invention, since the erection workbench is provided to be fit to the minimum unit of the frame, the weight of each workbench is small and no large force is needed for lifting the erection workbench itself. As the lifting works of the column members and the beam members can be practiced in a close position to the erection workbench, the lifting crane attached to the erection workbench can be a comparatively lower capacity. Therefore, as no large tower crane of a conventional type is needed and it can do without any reinforcement of the frames, the large cost reduction can be attained.

In addition, since all the erection works for the column members and the beam members can be performed on the workbench of the erection workbench, the safety in the construction works is dramatically improved. Further, the automation of the execution is possible by loading construction robots in accordance with the objects such as a bolting robot or a welding robot on the erection workbench. As a result, it becomes possible to overcome the labor shortage problem.

Moreover, as the works can be practiced without receiving any influences of weather because of the existence of the roof or the erection workbench, the term of works can be shortened, and the day off of workers due to rainy weather is not needed, which results further increase in the efficiency in the executions. Furthermore, as the erection workbench can move up and down in the vertical direction, and right and left horizontally, the executable range of an erection workbench is greatly increased. Therefore, especially when the size of building to be constructed is large, the construction works can be proceeded with an extremely high efficiency by employing the small number of the erection workbenches of the present invention, resulting in a large cost reduction.

I claim:

1. A method for constructing a frame of building by assembling column members and beam members in a vertical direction and a horizontal direction wherein four of said column members constitute a minimum unit of the frame, said method comprising the steps of:

a. providing a plurality of extension columns at an inside area defined by said four column members forming said minimum unit of frame, each of said extension columns comprising a fixed column and a column base;

b. providing a plurality of support arms at lower ends of said fixed column and said column base for connecting said extension columns to said beam members;

c. affixing a workbench horizontally at intermediate positions of said extension columns for executing construction work, said workbench being provided with construction machines including a lifting crane;

d. attaching a plurality of tie-beams horizontally to lower positions of said fixed columns, said tie-beams being provided with a plurality of wheels;

e. extending said column base with the use of a drive mechanism to change the vertical position of said erection workbench to reach an upper layer of said frame;

f. connecting said fixed columns of said extension columns to said beam member of said upper layer and retracting said column base into said fixed column;

g. performing construction work for said minimum units;

h. shifting the horizontal position of said erection workbench by rolling said wheels on said beam members for performing said construction work on other minimum units;

i. repeating steps (e) through (h) until completion of said construction of said frame.

2. A method for constructing a frame of building as defined in claim 1 further including the step of:

attaching a roof to higher ends of said fixed columns for executing said construction work regardless of weather conditions, said roof also functioning as said workbench for said construction work.

3. The method of claim 2, further comprising the steps of:

a. vertically raising said erection workbench by elevating a first portion of each of said extension columns while supporting said erection workbench by means of a second portion of each of said extension columns, said second portion being secured to a frame structure on said first floor;

b. supporting said erection workbench in position adjacent said next upper floor by means of said first portion of each of said extension columns; and c. lifting said second portion of each of said extension columns upwards so as to be adjacent next upper floor.

4. A method for constructing a frame of building as defined in claim 1 further including the step of:

retracting said support arms within said fixed columns or said column bases when they are not used for supporting said erection workbench on said beam members.

5. A method for constructing a frame of building as defined in claim 1 further including the step of:

extending a scaffold from the edge of said workbench to an outer side of said minimum unit of said frame.

6. A method for constructing a frame of building as defined in claim 1 further including the step of:

adapting said wheels to bypass said column members when said erection workbench changes said horizontal position.

7. A method for constructing a frame of building as defined in claim 1 further including the step of:

providing construction machines including a lifting crane to said fixed column.

8. A method for constructing a frame of building as defined in claim 1 further including the step of:

providing construction machines including a lifting crane to said roof.

9. A method for constructing a frame of building as defined in claim 1 including an erection of frame structures by assembling column members and beam members in a vertical and horizontal directions so as to form floors defined by said beam members, said method comprising the steps of:

a. providing an erection workbench adjacent a frame structure on a first one of said floors, said workbench having a plurality of extension columns;

b. horizontally shifting the positions of said erection workbench to another frame structure on said first floor; and c. raising the vertical position of said erection workbench so as to be adjacent the next upper floor.

* * * * *